US005557802A

United States Patent [19]

Wickert

[11] Patent Number: 5,557,802

[45] Date of Patent: Sep. 24, 1996

[54] PAD ASSEMBLY WITH RELEASABLE CUSHION

[76] Inventor: Neal C. Wickert, 5621 Overlook Dr., Bloomington, Minn. 55437

[21] Appl. No.: 231,497

[22] Filed: Apr. 22, 1994

[51] Int. Cl.[6] ..... A41D 13/00

[52] U.S. Cl. ..... 2/2

[58] Field of Search ..... 2/2, 22, 267, 45, 2/268

[56] References Cited

U.S. PATENT DOCUMENTS

| | | | |
|---|---|---|---|
| 3,248,738 | 5/1966 | Morgan . | |
| 4,512,037 | 4/1985 | Vacanti . | |
| 4,554,681 | 11/1985 | Kirkland . | |
| 4,590,622 | 5/1986 | Wolfe et al. | 2/2 |
| 4,675,912 | 6/1987 | Kirkland . | |
| 4,700,402 | 10/1987 | Vacanti . | |
| 5,423,087 | 6/1995 | Krent et al. | 2/2 |

*Primary Examiner*—Paul C. Lewis

[57] ABSTRACT

A protective pad assembly is used to protect upper body parts of contact sport athletes such as hockey players. The pad assembly has a relatively rigid first shield and a relatively rigid second shield pivotally connected to the first shield. An inner air entrained cushion is releasably attached to the first shield and closely conforms to the upper body part to be protected. The cushion includes a flexible case that surrounds a plurality of chambers accommodating flexible shock absorbent pads. The case has a pair of sheet members having adjacent outer peripheral edges and adjacent intermediate sections connected together to enclose the pad between the sheet members within the chambers and provide increased flexibility to the cushion. Releasable straps extend through the cushion and the first shield to releasably hold the cushion and first shield together.

19 Claims, 5 Drawing Sheets

PAD ASSEMBLY WITH RELEASABLE CUSHION

FIELD OF THE INVENTION

The invention relates to protective equipment useable primarily by athletes participating in contact sports, especially pad assemblies for protection of body parts of the athlete.

BACKGROUND OF THE INVENTION

Many sports involve frequent and sometimes violent body contact with objects and opposing players. The sport of hockey, for example, is particularly hazardous due to the high velocity imparted to the puck as well as the momentum generated by swinging hockey sticks. Body checking and forceful collisions with the boards and ice are common place in hockey games and practices.

SUMMARY OF THE INVENTION

The invention is directed to a protective pad assembly for protection of the body of a person for external impact forces. The pad assembly is used in environments where a person's body may be subjected to blows and forces that can cause injury. The arms, chest, rib cage, thighs and legs of a person can be protected with the pad assembly of the invention shaped to conform to the selected body part. The following description is directed to a protective pad assembly for the chest and shoulder areas of an ice hockey player. One pad assembly is used to protect the left side of the player's body and a second pad assembly protects the right side of the body. Each pad assembly has a first shield of relatively rigid material having a longitudinal curved shape. The first shield is in conformance with the curvature of the chest to be protected and is somewhat larger than the shoulder to be protected and is pivotally connected to the first shield. The pad assembly has a cushion having an outer periphery that is shaped to conform to the interior surfaces of the outer shield. The cushion is positioned to contact the chest and shoulder areas of the player's upper body. One side of the cushion has a recess to accommodate the player's neck. The other side of the cushion has an outwardly extended curved portion useable to protect the collar bone and adjacent body areas of the hockey player. Releasable straps having first and second ends with releasably interlocking complimentary surfaces extend through slots in the chest shield and the cushion to releasably connect the chest shield and the cushion together. This allows the cushion to be removed from the outer shell for cleaning or for substitution with cushions having different thicknesses whereby one outer shell can be connected to several different sized cushions as desired.

The cushion comprises a pair of flexible sheet members connected together at their outer peripheral edges and intermediate sections to define a plurality of chambers. The intermediate sections have a reduced thickness to substantially facilitate bending and fitting of the cushions to the outer shell and body of the user as may be necessary. Each chamber accommodates a pad of material that substantially fills the chamber. The pad of material is a springy compressible air entrained material, such as open cell plastic foam. Other types of materials can be used as a pad to fill the separate chambers of the cushion. The sheet members hold the pads under less than complete compression. Each chamber has a pair of openings in the sheet members that are open to opposite sides of the chamber for permitting air flow through the sheet members and out of the pads upon further compression of the pads from impact of an external force on the shields. The openings also permit air flow through the sheet members and into the pads upon expansion of the pads when the impact force has dissipated.

DESCRIPTION OF PREFERRED EMBODIMENT

Figure 1:
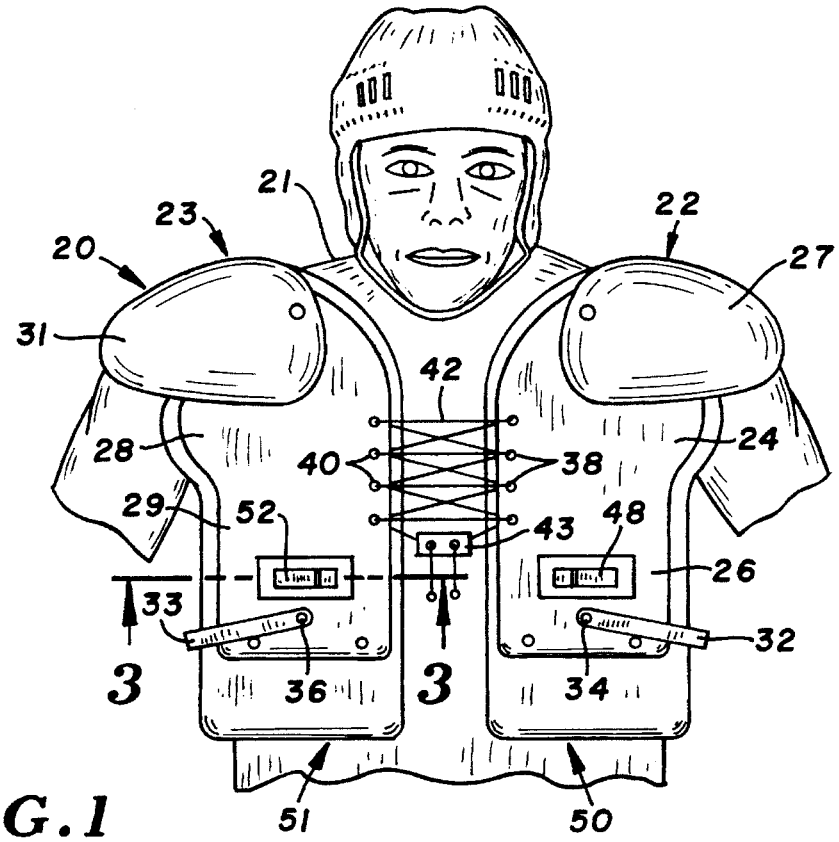
FIG. 1 is a front elevational view of a pair of pad assemblies of the invention, comprised as a shoulder and upper body pad assembly for the sport of hockey fitted on the upper body of a hockey player.

Referring to the drawing, there is shown in FIG. 1 a protective pad assembly of the invention indicated generally at 20 useable for hockey having left and right pad assemblies 22, 23 fitted on the shoulders and upper body portions of a hockey player 21. Pad assembly 20 is effective to deflect blows from objects, such as pucks, hockey sticks and protective equipment, and collisions with other hockey players, and absorb and dispense the force of impact. The protective pad assembly can be adapted to protect other parts of a person's body including, but not limited to, the feet, legs, thighs, waist, rib cage and head. The parts of the pad assembly can be shaped to cover the selected parts of the body for protection thereof. The following description is directed to a protective pad assembly for ice hockey players as shown in FIGS. 1 and 2.

Figure 2:
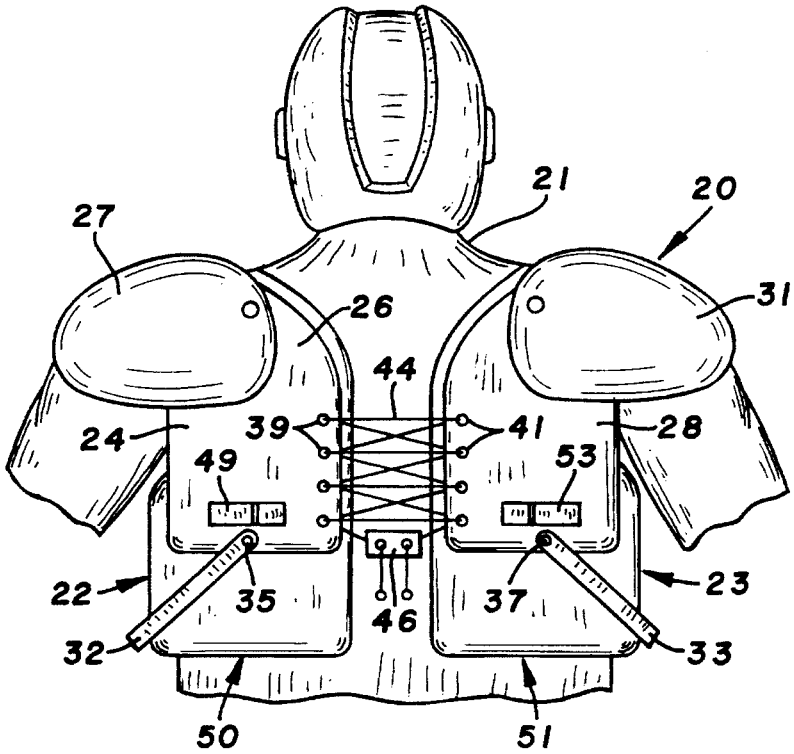
FIG. 2 is a rear elevational view of the shoulder and upper body pad assembly of FIG. 1.

As shown in FIGS. 1 and 2, the left shoulder and upper body pad assembly 22 includes an outer shell 24 having a chest shield 26 and shoulder shield 27 comprised of a strong, relatively rigid but light-weight material such as vacuum formed plastic. Shield 26 is shaped to conform generally to the left side rib cage and chest of hockey player 21 but substantially larger in order to accommodate an air cushion indicated generally at 50. Shield 27 is shaped to conform generally to the left shoulder of hockey player 21 but allows room for air cushion 50 between shield 27 and the shoulder. The inner end of shoulder shield 27 is pivotally attached to the top portion of chest shield 26. Shields 26 and 27 protect the medial, forward and distal portions of the chest and left shoulder.

Similarly, the right side shoulder and upper body pad assembly 23 has an outer shell 28 having a chest shield 29 and a shoulder shield 31. Shields 29 and 31 are comprised of a strong, rigid but light-weight material such as vacuum formed plastic. Other materials can be used to construct shields 26, 27, 29, and 31. Shield 29 has a shape to conform generally to the right side rib cage and chest of hockey player 21 but substantially larger in order to accommodate an air cushion of the invention indicated generally at 51. Shield 31 has a shape that conforms generally to the right shoulder of hockey player 21 but allows space for pad 72 of air cushion 51. The proximal end of shield 31 is pivotally attached to the upper portion of shield 29. Shields 29 and 31 protect the medial, forward and distal portions of the chest and right shoulder of hockey player 21.

Releasable straps 32, 33 are used to retain pad assemblies 22 and 23 on the upper body of hockey player 21. Strap 32 extends from a button 34 on the front of shield 26 around the left side of the hockey player 21 to a button 35 on the back of shield 26. Strap 33 extends between button 36 and button 37 on shield 29 around the right side of hockey player 21. A string 42 threaded through holes 38 and 40 in adjacent side edges of chest shields 26 and 29 holds the front portions of pad assemblies 22 and 23 together. A slide closure member 43 can be used to tighten string 42 as desired. The rear portions of pad assemblies 22 and 23 are held together with a second string 44 in a similar manner. As shown in FIG. 2, string 44 is threaded through holes 39 and 41 in the adjacent edges of shields 26 and 29. Slide closure member 46 accommodating string 44 can be used to adjust the tightness of string 44 as necessary to hold the rear portions of pad assemblies 22 and 23 together.

Air cushion 50 is releasably fitted to the interior surface of outer shell 24. The outer perimeter of cushion 50 conforms substantially to the outer perimeter of chest shield 26 but is slightly larger as shown in FIGS. 1 and 2. Releasable straps 48 and 49 extending through aligned holes or slots in cushion 50 and shield 26 releasably fit and retain cushion 50 to the interior surface of shield 26. Cushion 50 can be unstrapped and removed from shell 24 for purposes of interchangeability with cushions of greater or less thickness, or for cleaning purposes, repair and the like. When fitted on the upper left body and shoulder, cushion 50 closely conforms to the surfaces of the shoulder and upper body.

Air cushion 51 has substantially the same design as air cushion 50 but is used to protect the right side of the body. Cushion 51 is releasably fitted to the interior surface of outer shell 28. The outer perimeter of cushion 51 is slightly larger than the outer perimeter of chest shield 29. Releasable straps 52 and 53 extending through aligned holes or slots 57, 58 and 59, 60 in cushion 51 and shield 29 releasably fit and retain cushion 51 to the inner surface of shield 29 whereby cushion 51 can be removed from shell 28 for cleaning, replacement, repair or the like.

Figure 3:
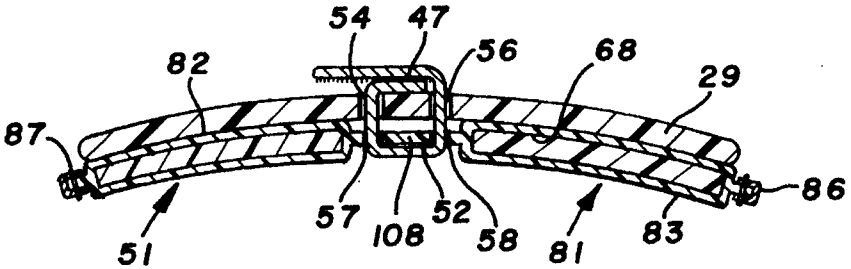
FIG. 3 is an enlarges sectional view taken along the line 3—3 of FIG. 1.

As shown in FIG. 3, to releasably fit cushion 51 to shield 29 the ends of strap 52 are threaded through slots 57 and 58 in a rectangular-shaped reduced thickness portion 108 of air cushion 51 and through slots 54 and 56 in the front of chest shield 29. Slots 57 and 58 are elongated generally parallel pair of openings in cushion 51. In like manner, slots 59 and 60 are generally parallel pair of openings in cushion 51. Fasteners 47, such as hook and loop members, located on adjacent surfaces of the ends of strap 52 co-operate to releasably secure the strap ends together thereby releasably fitting the front of cushion 51 to the forward portion of chest shield 29. Similarly, strap 53 is threaded through slots 59 and 60 in a rectangular-shaped reduced thickness portion 117 of the rear of cushion 51 and through slots (not shown) in the rear of chest shield 29 to releasably fit the rear of cushion 51 to the rear portion of chest shield 29. Strap 53 has releasable fasteners, such as hook and loop members, as shown at 47 in FIG. 3 to retain strap 53 in a closed loop to hold cushion 51 on shield 29.

Referring to FIGS. 4 through 8, air cushion 51 has an outer case 81. Case 81 has a pair of flexible sheet members 82 and 83 that are connected together at their outer peripheral edges 84. Sheet members 82 and 83 having inner layers 85 of air impervious plastic which are heat sealed along their outer peripheral edges and adjacent portions thereof. An elongated fabric strip 86 is attached to the outer peripheral edges 84 with a seam 87 to join sheet members 82 and 83 together and cover the edges of cushion 51 to minimize cutting of a person's body. Air cushion 51 has a generally U-shaped recess 119 interposed in one side thereof to accommodate the neck of the hockey player. The distal peripheral edge of cushion 51 has a first outwardly curved portion 121 to protect the shoulder of the hockey player. A second outwardly curved portion 122 of the cushion 51 adjacent curved portion 121 is used to protect the collar bone and front portion of the shoulder of the player.

Referring to FIGS. 9 through 16, case 81 has a plurality of chambers 61–64 and 66–70 for accommodating air and compressible pads 71–74 and 76–80. Preferably, pads 71–74 and 76–80 are foam plastic or rubber open cell structures that have a memory to return the pads to their original flat positions. Pads 71–74 and 76–80 can be other types of padding materials including other types of foamed plastic, particulates and fibers. The flexible sheet members 82 and 83 are connected together at intermediate sections 109, 111–116 and 118 to define the separate chambers 61–64 and 66–70. The inner layers 85 of plastic are heat sealed together along each intermediate section 109, 111–116 and 118 to prevent air flow between adjacent chambers and limit outward expansion of the sheet members. The intermediate sections 109, 111–116 and 118 are flexible and have a reduced thickness to allow cushion 51 to fold or bend so as to substantially conform to the curvatures of outer shell 28 and the upper body of hockey player 21.

Figure 9:
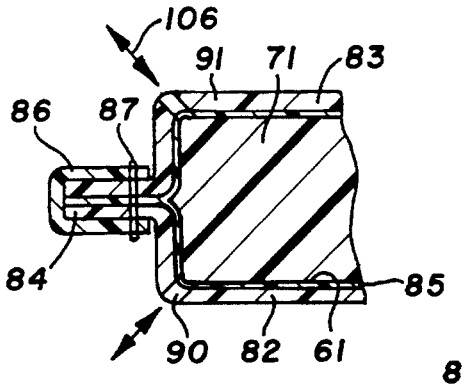
FIG. 9 is an enlarged sectional view of the back end of the cushion taken along the line 9—9 of FIG. 4.
Figure 10:
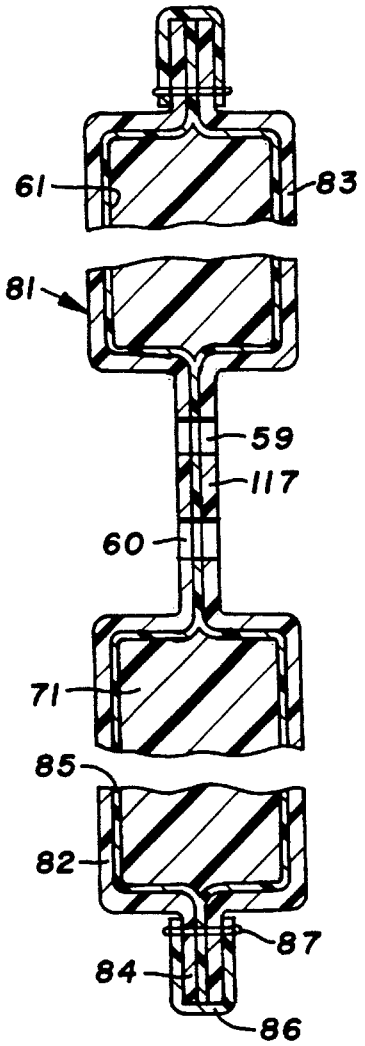
FIG. 10 is an enlarged sectional view taken along the line 10—10 of FIG. 4.

As shown in FIGS. 9 and 10, pad 71 is generally flat and rectangular-shaped having et flat upper and lower sides that are located in surface engagement with the inside surfaces of the flexible sheet members 82 and 83. Pad 71 is retained under normal compression within chamber 61 by flexible sheet members 82 and 83. Pad 71 fills the entire chamber 61 and maintains the flexible sheet members 82 and 83 in a generally taut condition. The expanded volume of chamber 61 is less than the normal expanded size of pad 71 so that the spring or expansion force of pad 71 is continuously maintained on sheet members 82 and 83. A center portion of chamber 61 is collapsed to provide reduced thickness portion 117. Center portion 117 has slots 59 and 60 to accommodate strap 53 useable to releasably attach the rear of cushion 51 to chest shield 29. The inner plastic layers 85 of sheet members 82 and 83 are heat sealed together at center portion 117 to increase the strength of portion 117.

Figure 4:
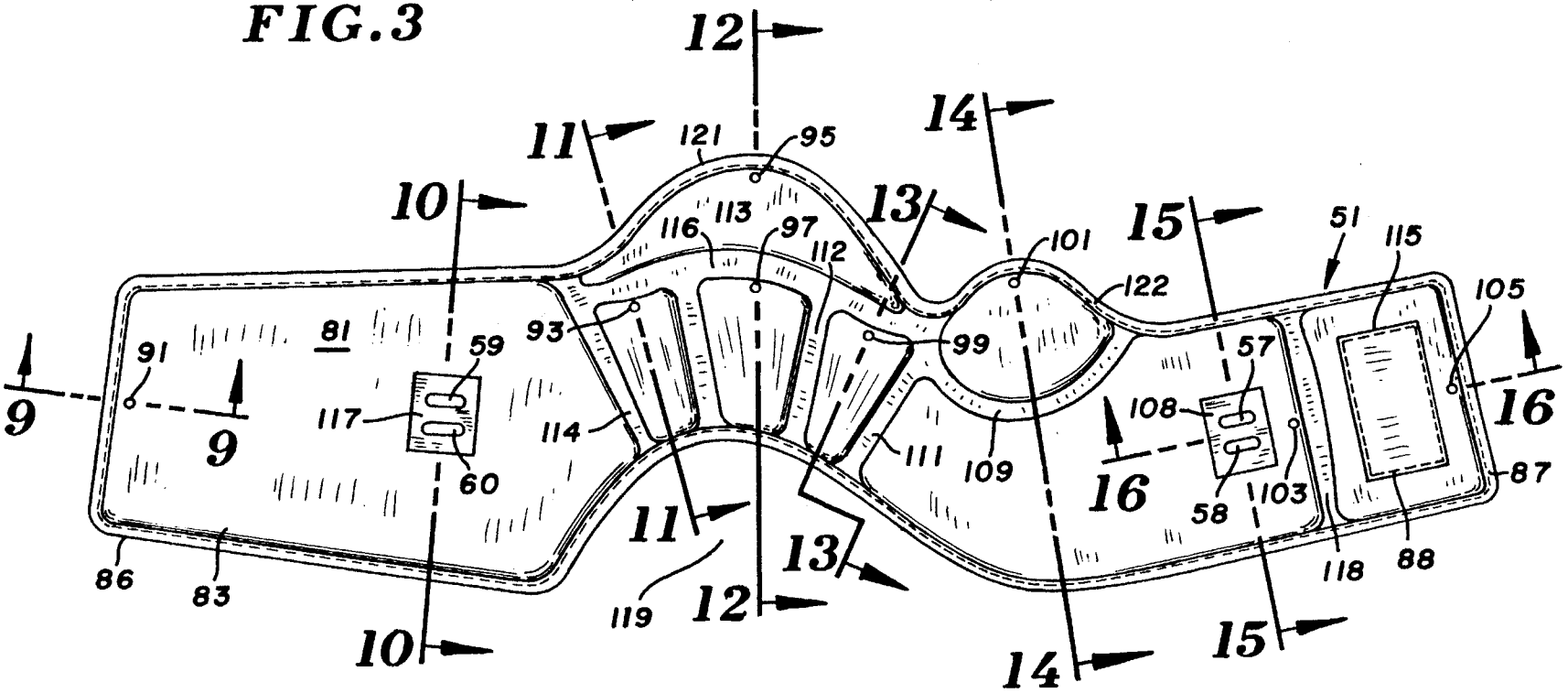
FIG. 4 is an enlarged top plan view of the right shoulder and chest cushion of the shoulder and upper body pad assembly of FIG. 1.
Figure 6:
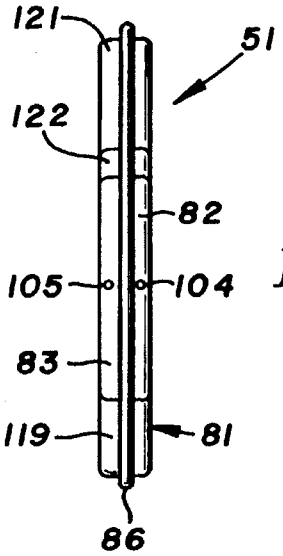
FIG. 6 is a front end view of the cushion of FIG. 4.
Figure 5:
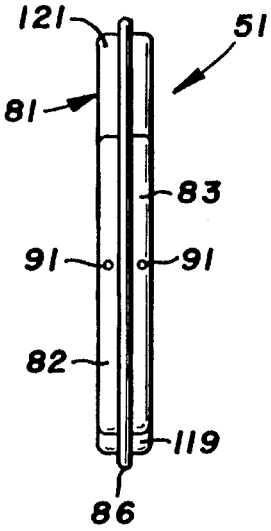
FIG. 5 is a back end view of the cushion of FIG. 4.
Figure 7:
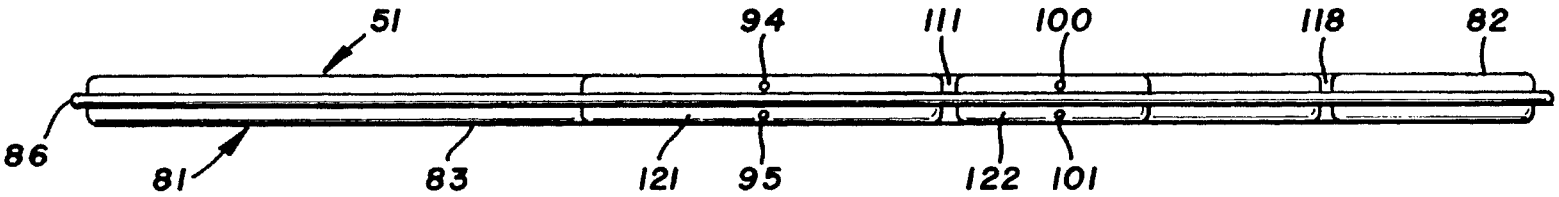
FIG. 7 is a distal side view of the cushion of FIG. 4.
Figure 8:
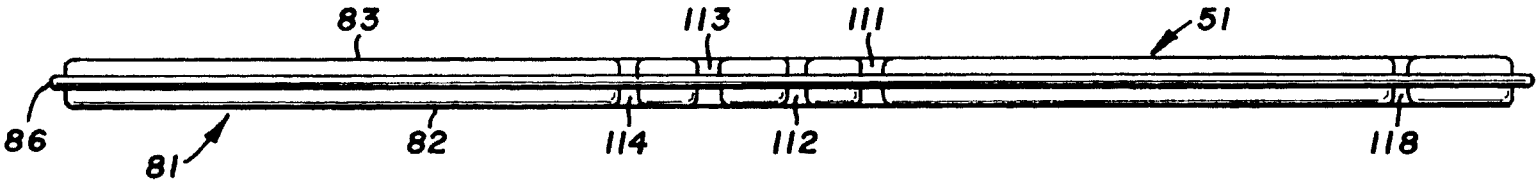
FIG. 8 is a proximal side view of the cushion of FIG. 4.

As shown in FIGS. 4 and 9, sheet members 82 and 83 have a pair of openings 90 and 91 adjacent outer peripheral edge 84 open to chamber 61. Openings 90 and 91 are located in adjacent opposite sides of cushion 51. The openings 90 and 91 are centrally located in the lower back portion of cushion 51.

Figure 11:
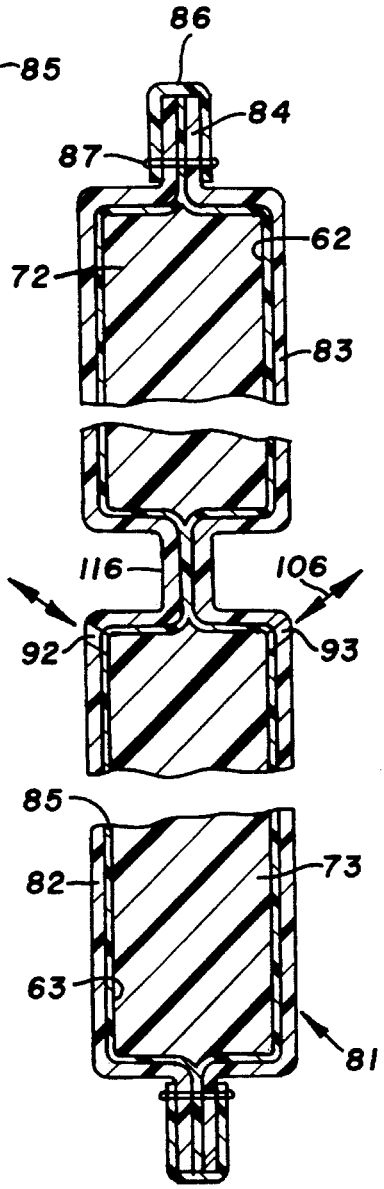
FIG. 11 is an enlarged sectional view taken along the line 11—11 of FIG. 4.
Figure 12:
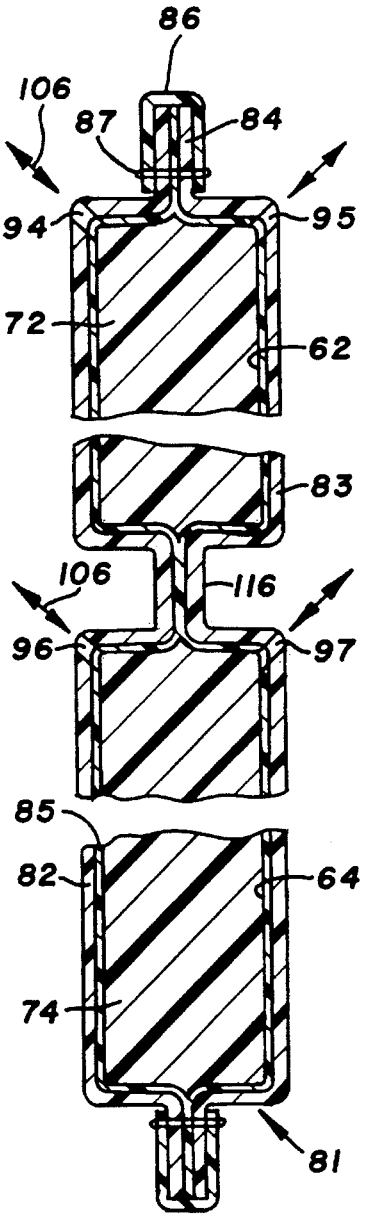
FIG. 12 is an enlarged sectional view taken along the line 12—12 of FIG. 4.
Figure 13:
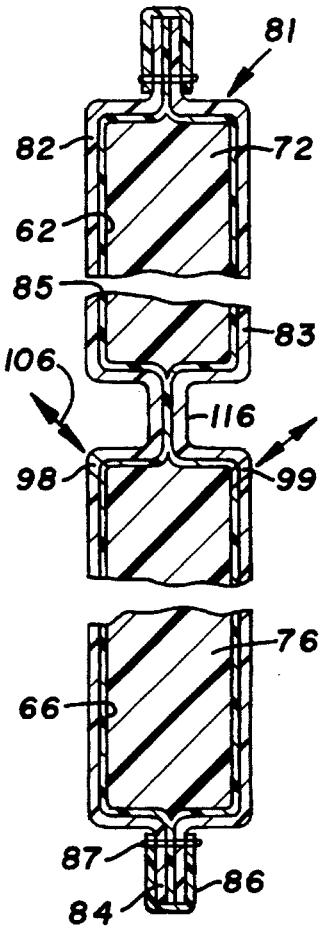
FIG. 13 is an enlarged sectional view taken along the line 13—13 of FIG. 4.

As shown in FIGS. 11, 12 and 13, pad 72 is generally flat and crescent shaped having a flat upper and lower sides that are located in surface engagement with the inside surfaces of sheet members 82 and 83. Pad 72 is retained under normal compression within chamber 62 by sheet members 82 and 83. Pads 73, 74 and 76 are generally flat and triangular-shaped each having flat upper and lower sides that are located in surface engagement with sheet members 82 and 83. Pads 73, 74 and 76 are retained within chambers 63, 64 and 66, respectively, under normal compression. Pads 73, 74 and 76 are located longitudinally along the middle section of cushion 51 inwardly from pad 72. Pads 72–74 and 76 fill chambers 62–64 and 66 maintaining sheet members 82 and 83 in a generally taut condition. The normal expanded sizes of pads 72–74 and 76 are greater than the expanded volumes of chambers 62–64 and 66 whereby the expansion forces of pads 72–74 and 76 are continuously maintained on the sheet members. Intermediate section 116 is located between pad 72 and pads 73, 74 and 76. Section 116 separates the inner end of chamber 62 and the outer ends of chambers 63, 64 and 66. As shown in FIG. 4, intermediate sections 112, 113, 114 extended transversely between intermediate section 116 and outer peripheral edge 84 separating chambers 61, 63, 64 and 66. Intermediate sections 112–114 and 116 facilitate the bending of cushion 51 to conform it to the curvature of the shoulder of hockey player 21 and outer shell 28.

Referring to FIGS. 4 and 11–13, sheet members 82 and 83 has a plurality of openings 92, 93, 94, 95, 96, 97, 98 and 99. These openings are located in pairs in opposite adjacent sides of cushion 51. Openings 92 and 93 are open to chamber 63 and centrally located along the side of chamber 63 adjacent intermediate section 116. Openings 94 and 95 are centrally located in the distal side portion of cushion 51 adjacent curve 121 of outer peripheral edge 84. The openings 94 and 95 are open to opposite sides of chamber 62. Openings 96 and 97, 98 and 99 are open to chambers 64 and 66, respectively. Openings 96 and 97 are centrally located along one side of chamber 64 adjacent intermediate section 116. Likewise, openings 98 and 99 are centrally situated along the side of chamber 66 adjacent section 116.

Figure 14:
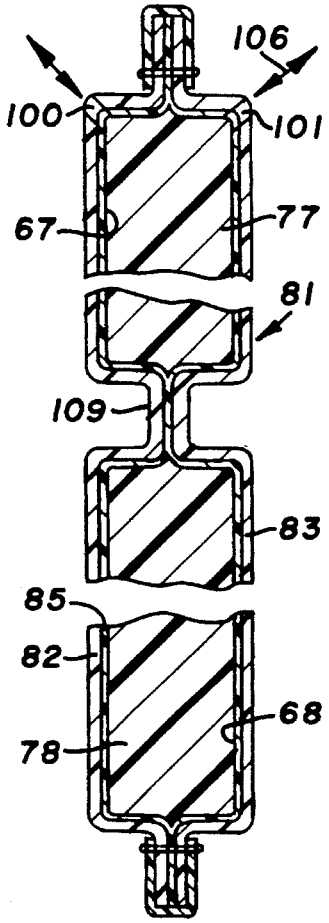
FIG. 14 is an enlarged sectional view taken along the line 14—14 of FIG. 4.

As shown in FIGS. 4 and 14, pad 77 is generally flat and oval-shaped being retained within chamber 67 under normal compression by sheet members 82 and 83 substantially the same as pads 71–74 and 76 within chambers 61–64 and 66. Pad 77 is used to protect the collar bone and front shoulder area of hockey player 21. Pad 78 is flat and generally rectangular-shaped and is retained in chamber 68. Pad 78 protects the front chest portion of player 21. Intermediate section 109 curves around pad 77 and pad 78 to separate chambers 67 and 68. Intermediate section 111 extends transversely between the ends of sections 109 and 116 and outer peripheral edge 84 to define ends of chambers 66 and 68. Sections 109 and 111 enable the user to bend and substantially conform cushion 51 to the shape of outer shell 28 and the body part to be protected.

Figure 15:
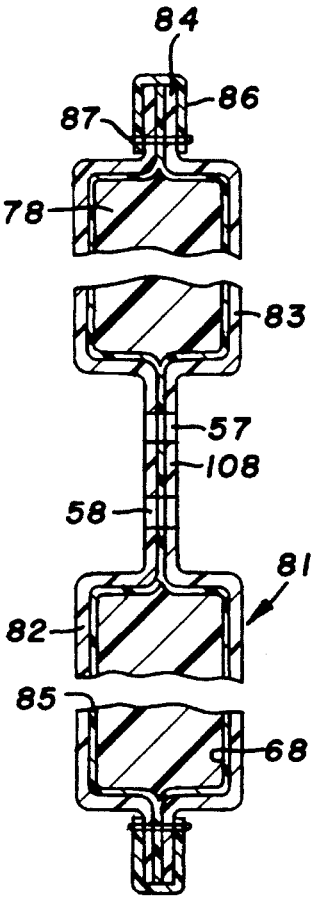
FIG. 15 is an enlarged sectional view taken along the line 15—15 of FIG. 4.

As shown in FIGS. 3 and 15, a center area of chamber 68 has a collapsed, rectangular-shaped portion 108. Center portion 108 is substantially identical to collapsed portion 117 of chamber 61. The center portion 108 has slots 57 and 58 to accommodate strap 52 to releasably attach the front of cushion 51 to chest shield 29 of outer shell 28. The inner layers 85 of plastic are heat sealed together at center portion 108 around slots 57 and 58 to increase the strength of portion 108. Fasteners 47, such as hook and loop members, co-operate to releasably hold strap 52 securely around cushion 51 and outer shell 28. Straps 48, 49 and 53 have fasteners substantially the same as fasteners 47 on strap 52 that co-operate to releasably hold cushions 50, 51 to outer shells 24, 28 in a like manner. This allows cushions 50, 51 to be easily removed and interchanged with cushions of various sizes and thicknesses, or for cleaning and repair purposes as needed. Straps 48, 49 and 52, 53 can be removed from the cushions and shields and replaced with new straps as they are not attached to either the shields or cushions.

Figure 16:
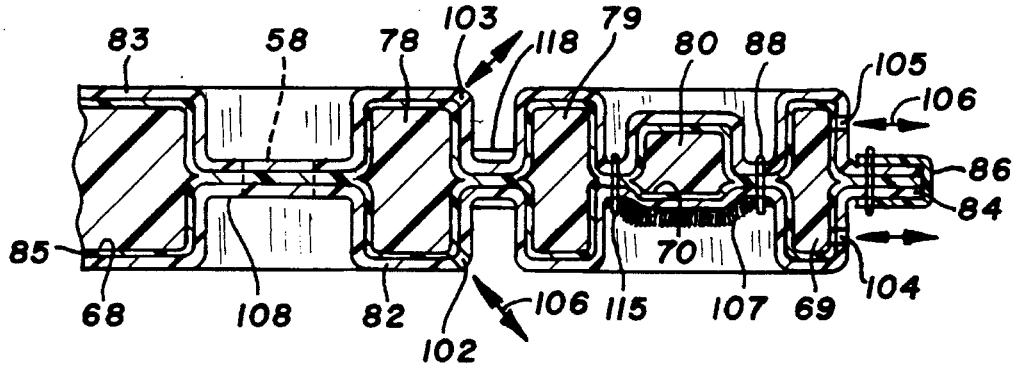
FIG. 16 is an enlarged sectional view of the front end of the cushion taken along the line 16—16 of FIG. 4.

Referring to FIGS. 4 and 14–16, openings 100, 101, 102, 103, 104 and 105 in sheet members 82 and 83 are arranged in pairs in opposite adjacent sides of air cushion 51. Openings 100 and 101 are centrally located on one side of chamber 67 adjacent curve 122 of outer peripheral edge 84 and are open to chamber 67. The pair of openings 102 and 103 open to chamber 68 are centered on the lower end of chamber 68 adjacent the middle of intermediate section 118. Section 118 extends between the outer peripheral edges 84 of cushion 51. Openings 104 and 105 are centrally located in the lower front portion of cushion 51 adjacent outer peripheral edge 84. These openings 104, 105 are open to lower end of chamber 69, as shown in FIG. 16.

Referring to FIGS. 4 and 16, pad 79 is accommodated by chamber 69 that surrounds inner rectangular-shaped pad 80 located in inner chamber 70. Sheet members 82 and 83 retain pads 79 and 80 within chambers 69 and 70 under normal compression. The spring or expansion forces of pads 79 and 80 are continuously maintained on sheet members 82 and 83 substantially the same as the expansion forces of pads 71–74 and 76–78 are maintained on the sheet members. An intermediate section 115 surrounding chamber 70 separates chamber 70 from outer chamber 69. A rectangular piece of fastener material 107, such as a loop fastener, is attached to the outer surface of sheet member 82 extending over pad 80 with a seam 88, as shown in FIG. 16. Fastener material 107 is useable to co-operate with fasteners, such as a hook fastener, attached to other protective equipment (not shown) to releasably attach cushion 51 to the protective equipment.

In use, pad assemblies 22 and 23 are located adjacent the chest and shoulders of a hockey player as shown in FIGS. 1 and 2. Releasable straps 32 and 33 extending between buttons 34 and 36 and buttons 35 and 37 and around the sides of hockey player 21 retain pad assemblies 22 and 23 on the upper body of the hockey player. Strings 42 and 44 hold adjacent front and back side edges of the pad assemblies 22 and 23 together. When an object such as a hockey puck or hockey stick hits pad assembly 23 or upon a collision with an opposing player or the rink boards, the force of impact is initially deflected by outer shell 28. Shell 28 functions also to partially disperse the force of impact. The impact force causes a deflection of cushion 51. Upon deflection, cushion 51 absorbs much of the impact force at a rate controlled by the amount of air that ,escapes through openings 90–105, as indicated by arrows 106 in FIGS. 9, 11, 12, 13, 14 and 16. Following deflection, air cushion 51 recovers its normal volume as air enters through openings 90–105 as shown by arrows 106.

The movement of air into and out of air cushion 51 moves independently into and out of the separate chambers 61–70 of air cushion 51. For example, when pad assembly 23 is struck with an object in the front portion of chest shield 29 adjacent chamber 61, the chamber 61 and pad 71 will be compressed. The remaining pads 72–74 and 76–80 and chambers 62–64 and 66–80 will be slightly compressed, if at all. The air chamber 61 and within pad 71 will move toward openings 90 and 91 and will be forced from chamber 61 and pad 71. The openings 91 and 92 are relatively small in size and partially restrict the flow of air that can be forced from chamber 61 and 71. The combined compression of the air and the compression of pad 71 absorbs substantially the impact force of the puck or the collision and distributes the force to a larger area of the upper body of player 21. When the force of the puck is dissipated, pad 71 will spring back to its initial nominal compressed condition. This causes air as shown by arrows 106 in FIG. 9 to flow back through openings 90 and 91 into chamber 61 and pad 71. The object by hitting the front of chest shield 29 does not cause the compression of chambers 62–70 and pads 72–80 or only causes a slight compression thereof. Pads 72–80 remain substantially in their nominal compressed condition not withstanding the compression of pad 71 and chamber 61. Thus, a plurality of impact forces occurring simultaneously on pad assembly 23 can be deflected and absorbed witch compression of the separate chambers and pads of cushion 51.

Objects hitting pad assembly 22 or collisions involving pad assembly 22 result in impact forces initially deflected by outer shell 24 and cushion 50 in a similar manner. Shell 24 functions to partially disperse the forces of impact and cushion 50 absorbs the force at a rate controlled by the air forced from the chambers and pads of cushion 50. Air cushion 50 recovers its normal volume as air re-enters the cushion 50. When cushions 50, 51 need cleaning or a different sized or thicker cushion is desired, straps 48, 49 and 52, 53 can be unstrapped to allow quick and easy separation of cushions 50, 51 from outer shells 24, 28. Straps 48, 49 and 52, 53 can be replaced in the event that they become torn or inoperative as they are not secured to the cushions or shields and can be readily removed from the cushions and shields and replaced with new straps.

While there has been shown and described a preferred embodiment of the protective pad assembly, it is understood that changes in size, shape, materials and structures can be made by those skilled in the art without departing from the invention. The invention is defined in the following claims.

I claim:

1. A protective pad assembly for protection of a chest and shoulder of a person's body from injury comprising: a first shield of relatively rigid material having a longitudinal curved shape in conformance with and larger than the chest to be protected, a second shield of relatively rigid material pivotally connected to the first shield, the second shield having a longitudinal curved shape in conformance with and larger than the shoulder to be protected, said first and second shields having interior surfaces and slots, a cushion having an outer periphery shaped to conform to said interior surfaces of the first and second shields and positioned to contact the chest and shoulder to be protected, the cushion comprising inner and outer flexible sheet means having a plurality of separate chambers and slots aligned with the slots in the first and second shields, said sheet means including inner and outer layers of air impervious plastic material having adjacent outer peripheral edges, said adjacent outer peripheral edges being joined together, said layers having intermediate sections joined together to separate said chambers from each other and prevent air from flowing between the chambers, said intermediate sections comprising reduced thickness portions of the cushion to facilitate the conformance of the cushion to the interior surfaces of the first and second shields and the chest and shoulder of the person to be protected, each chamber accommodating a continuous pad of springy compressible air entrained open cellular material that completely fills the chamber, the sheet means holding the pads under less than complete compression thereof, and at least one opening in one of the sheet means in communication with each of said chambers for permitting air flow through the sheet means and out of each of the pads upon further compression of the pads from impact of an external force on the shields and through the sheet means and into the pads upon expansion of the pads, and releasable strap means releasably connecting the cushion to the first shield and second shield, the releasable strap means extending through the slots in the first and second shields and cushion and having a first end and a second end opposite from the first end, the first and second ends having releasable cooperating means for holding said first and second ends together.

2. The protective pad assembly of claim 1 wherein: the opening includes a plurality of openings in the sheet means located in pairs at least one in opposite adjacent sides of the inner and outer sheet means, each chamber having one pair of openings open thereto allowing air to move into the chamber and out of the chamber.

3. The protective pad assembly of claim 1 wherein: the releasable strap means comprise a first releasable strap extending through first slots in adjacent front portions of the first shield and cushion, and a second releasable strap extending through second slots in adjacent rear portions of the first shield and cushion.

4. The protective pad assembly of claim 1 wherein: the first and second ends of the releasable strap means have releasably interlocking members positioned for engagement when the strap means are properly positioned around the first shield and cushion.

5. The protective pad assembly of claim 1 wherein: the cushion has a chest portion and a shoulder portion, one side of the cushion has a recess to accommodate a neck of a person.

6. The protective pad assembly of claim 1 wherein: the cushion has a chest portion and a shoulder portion, one side of the cushion has an outwardly curved portion for protection of a collar bone of a person's body from injury.

7. A protective pad assembly for protecting body parts from injury comprising: a first shield of relatively rigid material shaped generally in conformance with and larger than a first body part to be protected, a second shield of relatively rigid material pivotally connected to the first shield, the second shield shaped generally in conformance with and larger than a second body part to be protected, said first and second shields having interior surfaces, a cushion having a plurality of separate chambers and a shape to conform to the interior surfaces of the first and second shields and positioned to contact the first and second body parts to be protected, the cushion including sheet means having inner and outer layers of air impervious material, said layers having adjacent outer peripheral edges, said adjacent outer peripheral edges being joined together, said layers having intermediate sections joined together to separate said chambers from each other and prevent air from flowing between the chambers, said intermediate sections comprising reduced thickness portions of the cushion to facilitate the conformance of the chamber to the interior surfaces of the first and second shields and body parts, a plurality of continuous pads of springy compressible air entrained open cellular material that expels air upon compression and returns air into the material upon expansion thereof, each chamber accommodating one of the pads, the pad substantially filling the chamber, the sheet means covering the pads and holding the pads in slight compression, and a plurality of openings only in the sheet means for permitting air flow through the sheet means and out of the chambers and pads upon compression of the pads from impact of an external force, and the flow of air into the chambers and pads upon expansion of the pads within the chambers, and releasable means releasably connecting the cushion to at least one of the first shield and second shield.

8. The pad assembly of claim 7 wherein: the plurality of openings in the sheet means are located in pairs in opposite sides of the sheet means, each chamber open to at least one pair of openings allowing air to flow into the chamber and out of the chamber.

9. The pad assembly of claim 7 wherein: the first shield and cushion have first slots in adjacent front portions thereof and second slots in adjacent rear portions thereof said releasable means comprise a first releasable strap extending through said first slots in the adjacent front portions of the first shield and cushion, and a second releasable strap extending through said second slots in the adjacent rear portions of the first shield and cushion.

10. The pad assembly of claim 9 wherein: each releasable strap has releasably interlocking members positioned for engagement when the strap is properly positioned around the first shield and cushion.

11. The pad assembly of claim 7 wherein: the cushion has a general shape of a chest portion and a shoulder portion of a person's body to be protected.

12. A cushion for use to protect a human body part from injury comprising: a case having a plurality of separate chambers and a pair of sheet members surrounding said plurality of chambers, said sheet members including inner and outer layers of air impervious material, said layers having adjacent outer peripheral edges joined together, and intermediate sections joined together to separate said chambers from each other and prevent air from flowing between the chambers, said intermediate sections comprising reduced thickness portions of the cushion to facilitate the conformance of the cushion to the human body part located adjacent the cushion, each chamber accommodating a continuous pad of air entrained open cellular, springy compressible material, the sheet members being of a flexible material, each pad being of a size to substantially fill the chamber accommodating the pad, each chamber having an internal dimension less than the fully expanded corresponding dimension of the pad accommodated by the chamber whereby the sheet members hold the pad in partial compression within the chamber, and a plurality of openings in at least one of the sheet members for permitting air flow only through said sheet members and out of the chambers and open cellular material of the pads for simultaneously absorbing and distributing impact forces applied thereof, and flow of air into the chambers and the open cellular material of the pads upon expansion of the pads.

13. The cushion of claim 12 wherein:

each sheet member having at least one pair of openings open to each chamber allowing air to move into each chamber and out of each chamber.

14. The cushion of claim 12 wherein: the cushion has a general shape of a chest portion and a shoulder portion of a person's body to be protected.

15. The cushion of claim 12 wherein: the cushion has a chest portion and a shoulder portion, one side of the cushion has a recess to accommodate a neck of a human body.

16. The cushion of claim 12 wherein: the cushion has a chest portion and a shoulder portion, one side of the cushion has an outwardly curved portion for protection of a collar bone of a human body from injury.

17. A protective pad assembly for protecting a body part from injury comprising: a shield of relatively rigid material shaped generally to conform with and larger than the body part to be protected, said shield having an interior surface and first slots, a cushion having a shape to conform to said interior surface of the shield, said cushion including air impervious sheet members providing a plurality of chambers, said sheet members having flexible intermediate sections surrounding said chambers and separating said chambers from each other, continuous pad means located in each of said chambers, said intermediate sections comprise reduced thickness portions of the cushion located between said chambers to facilitate the conformance of the cushion to the interior surface of the shield and the body part to be protected, at least one opening in one of the sheet members open to each of said chambers to allow air to flow into and out of each of said chambers independently of each other and said cushion having second slots aligned with the first slots in the shield, said sheet members including heat sealable plastic, said plastic being fused together around said second slots to reinforce the sheet members surrounding the second slots, and strap means extended through said aligned first and second slots in the shield and cushion to hold the cushion on the shield, said strap means having releasable fasteners whereby the strap means can be removed from the shield and cushion to allow the cushion to be separated from the shield.

18. The protective pad assembly of claim 17 wherein:

the opening includes a plurality of openings in the sheet members to allow air to flow into and out of each of said chambers.

19. The protective pad assembly of claim 17 wherein: the shield has pairs of adjacent generally parallel slots and said cushion has pairs of adjacent generally parallel slots aligned with the pairs of slots in the shield, said strap means comprising a single strap extended through the aligned pairs of slots, said releasable fastening means connecting adjacent portions of the strap to retain the cushion on the shield.

* * * * *